US010636433B2

(12) United States Patent
Stylianou

(10) Patent No.: US 10,636,433 B2
(45) Date of Patent: Apr. 28, 2020

(54) SPEECH PROCESSING SYSTEM FOR ENHANCING SPEECH TO BE OUTPUTTED IN A NOISY ENVIRONMENT

(71) Applicant: KABUSHIKI KAISHA TOSHIBA, Minato-ku (JP)

(72) Inventor: Ioannis Stylianou, Cambridge (GB)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/648,455

(22) PCT Filed: Nov. 7, 2014

(86) PCT No.: PCT/GB2014/053320

§ 371 (c)(1),
(2) Date: May 29, 2015

(87) PCT Pub. No.: WO2015/067958

PCT Pub. Date: May 14, 2015

(65) Prior Publication Data

US 2016/0019905 A1 Jan. 21, 2016

(30) Foreign Application Priority Data

Nov. 7, 2013 (GB) ..... 1319694.4

(51) Int. Cl.
*G10L 21/0208* (2013.01)
*G10L 21/0232* (2013.01)
(Continued)

(52) U.S. Cl.
CPC ..... *G10L 21/0208* (2013.01); *G10L 21/0205* (2013.01); *G10L 21/0232* (2013.01);
(Continued)

(58) Field of Classification Search
CPC ..... G10L 21/0208; G10L 21/0232; G10L 21/0205; G10L 21/0364; G10L 25/84;
(Continued)

(56) References Cited

U.S. PATENT DOCUMENTS

2003/0002659 A1 1/2003 Erell
2006/0271358 A1 11/2006 Erell
(Continued)

FOREIGN PATENT DOCUMENTS

CN 102246230 A 11/2011
EP 1 286 334 A2 2/2003
WO WO 02/097977 A2 12/2002

OTHER PUBLICATIONS

International Search Report and Written Opinion of the International Searching Authority dated Feb. 9, 2015, in PCT/GB2014/053320, filed Nov. 7, 2014.
(Continued)

*Primary Examiner* — Akwasi M Sarpong
(74) *Attorney, Agent, or Firm* — Oblon, McClelland, Maier & Neustadt, L.L.P.

(57) ABSTRACT

A speech intelligibility enhancing system for enhancing speech to be outputted in a noisy environment, the system comprising: a speech input for receiving speech to be enhanced; a noise input for receiving real-time information concerning the noisy environment; an enhanced speech output to output said enhanced speech; and a processor configured to convert speech received from said speech input to enhanced speech to be output by said enhanced speech output, the processor being configured to: apply a spectral shaping filter to the speech received via said speech input; apply dynamic range compression to the output of said spectral shaping filter; and measure the signal to noise ratio at the noise input, wherein the spectral shaping filter comprises a control parameter and the dynamic range compression comprises a control parameter and wherein at least one of the control parameters for the dynamic range compression or the spectral shaping is updated in real time according to the measured signal to noise ratio.

21 Claims, 6 Drawing Sheets

(51) Int. Cl.

| | |
|---|---|
| ***G10L 25/18*** | (2013.01) |
| ***G10L 25/84*** | (2013.01) |
| ***G10L 21/02*** | (2013.01) |
| ***G10L 21/0364*** | (2013.01) |
| *G10L 21/0216* | (2013.01) |
| *G10L 25/93* | (2013.01) |

(52) U.S. Cl.
CPC ..... *G10L 21/0364* (2013.01); *G10L 25/18* (2013.01); *G10L 25/84* (2013.01); *G10L 25/93* (2013.01); *G10L 2021/02085* (2013.01); *G10L 2021/02165* (2013.01)

(58) Field of Classification Search
CPC . G10L 2021/02085; G10L 2021/02165; G10L 21/02; G10L 25/18; G10L 25/93
See application file for complete search history.

(56) References Cited

U.S. PATENT DOCUMENTS

| | | | | |
|---|---|---|---|---|
| 2008/0140396 | A1* | 6/2008 | Grosse-Schulte | G10L 15/20 704/227 |
| 2009/0281800 | A1* | 11/2009 | LeBlanc | G10L 21/0208 704/224 |
| 2009/0287496 | A1 | 11/2009 | Thyssen et al. | |
| 2010/0017205 | A1* | 1/2010 | Visser | G10L 19/00 704/225 |
| 2010/0020986 | A1* | 1/2010 | Nemer | H04R 3/00 381/94.1 |
| 2010/0121635 | A1 | 5/2010 | Erell | |
| 2011/0125490 | A1* | 5/2011 | Furuta | G10L 21/0232 704/205 |
| 2012/0101816 | A1 | 4/2012 | Erell | |
| 2013/0282373 | A1* | 10/2013 | Visser | G10L 21/0208 704/233 |
| 2014/0056435 | A1* | 2/2014 | Kjems | H04M 9/082 381/66 |

OTHER PUBLICATIONS

Great Britain Search Report dated May 8, 2014, in Patent Application No. GB1319694.4, filed Nov. 7, 2013.

Emma Jokinen, et al., "Signal-to-noise ratio adaptive post-filtering method for intelligibility enhancement of telephone speech", The Journal of the Acoustical Society of America, vol. 132, No. 6, XP 012163510, Dec. 2012, pp. 3990-4001.

Tudor-Cătălin Zorilă, et al., "Speech-in-noise intelligibility improvement based on spectral shaping and dynamic range compression", INTERSPEECH, XP 002734717, Sep. 9-13, 2012, pp. 635-638 (with presentation).

Henning Schepker, et al., "Improving speech intelligibility in noise by SII-dependent preprocessing using frequency-dependent amplification and dynamic range compression", INTERSPEECH, XP 002734731, Aug. 25-29, 2013, pp. 3577-3581.

Combined Office Action and Search Report dated Mar. 13, 2017 in Chinese Patent Application No. 2014800032369 (English translation only).

T.C. Zorila et al., "Speech-In-Noise Intelligibility Improvement Based On Power Recovery And Dynamic Rangei Compression", EUSIPCO 2012, pages 2075-2079.

Sungyub D. Yoo, et al., "Speech signal modification to increase intelligiblity in noisy environment", The Journal of the Acoustical Society of America, vol. 122, No. 2, Aug. 2007, pp. 1138-1149.

Thomas F. Quatieri et al., "Peak-to-RMS Reduction of Speech Based on a Sinusoidal Model", IEEE Trans. on signal processing, vol. 39, No. 2, Feb. 1991, pp. 273-288.

Douglas B. Paul, "The Spectral Envelope Estimation Vocoder", IEEE Trans. On Acoustics, Speech and Signal Processing. vol. ASSP-29, No. 4, Aug. 1961, pp. 786-794.

Russell S. Niederjohn, et al., "The Enhancement of Speech Intelligibility in High Noise Levels by High-Pass Filtering Followed by Rapid Amplitude Compression", IEEE Trans Acoustic, Speech, and Signal Processing, vol. ASSP-24, No. 4, Aug. 1976, pp. 277-262.

Youyi Lu, et al., "Speech production modifications produced by competing talkers, babble, and stationary noise", The Journal of the Acoustical Society of America vol. 124, No. 5, Nov. 2006, pp. 3261-3275.

Valerie Hazan et al., "Acoustic-phoentic characteristic of speech produced with communicative intent to counter adverse listening conditions", The Journal of the Acoustical Society of America vol. 130, No. 4, Oct. 2011, pp. 2139-2152.

Valerie Hazan et al., "Cue-Enhancement Strategies for Natural VCV And Sentence Materials Presented In Noise", Speech and Language, 9:43-55, 1996.

Martin Cooke et al., "Evaluating the intelligibility of speech modifications in known noise conditions", Speech Communication, 2013, pp. 572-585, http://dx.doi.org/10.10168/j.specom.2013.01.001.

Berry A. Blesser, Audio Dynamic Range Compression For Minimum Perceived Distortion, IEEE Transactions on Audio and Electroacoustics, vol. AU-17, No. 1, 1969, pp. 22-32.

* cited by examiner

SPEECH PROCESSING SYSTEM FOR ENHANCING SPEECH TO BE OUTPUTTED IN A NOISY ENVIRONMENT

FIELD

Embodiments described herein relate generally to speech processing system

BACKGROUND

It is often necessary to understand speech in noisy environment, for example, when using a mobile telephone in a crowded place, listening to a media file on a mobile device, listening to a public announcement at a station etc.

It is possible to enhance a speech signal such that it is more intelligible in such environments.

BRIEF DESCRIPTION OF THE DRAWINGS

Systems and methods in accordance with non-limiting embodiments will now be described with reference to the accompanying figures in which.

DETAILED DESCRIPTION

Figure 1:
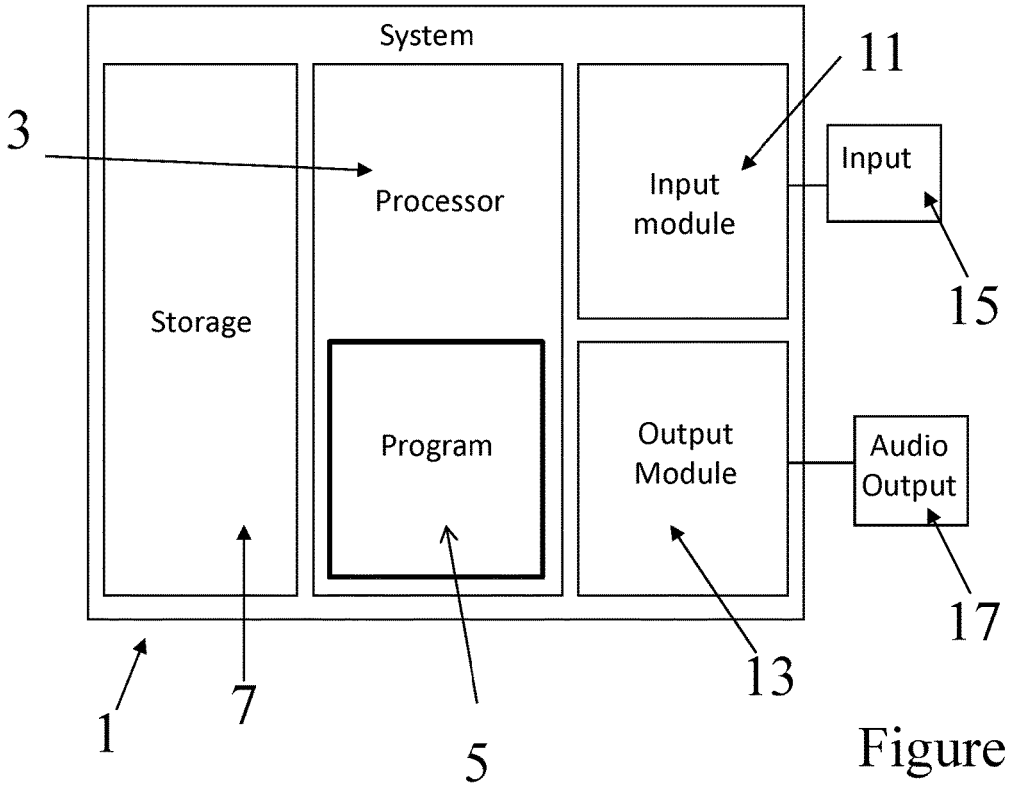
FIG. 1 is a schematic of a system in accordance with an embodiment of the present invention.

In an embodiment, a speech intelligibility enhancing system is provided for enhancing speech to be outputted in a noisy environment, the system comprising:

- a speech input for receiving speech to be enhanced;
- a noise input for receiving real-time information concerning the noisy environment;
- an enhanced speech output to output said enhanced speech; and
- a processor configured to convert speech received from said speech input to enhanced speech to be output by said enhanced speech output,
- the processor being configured to:
  - apply a spectral shaping filter to the speech received via said speech input;
  - apply dynamic range compression to the output of said spectral shaping filter; and
  - measure the signal to noise ratio at the noise input,
  - wherein the spectral shaping filter comprises a control parameter and the dynamic range compression comprises a control parameter and wherein at least one of the control parameters for the dynamic range compression or the spectral shaping is updated in real time according to the measured signal to noise ratio.

In systems in accordance with the above embodiments, the output is adapted to the noise environment. Further, the output is continually updated such that it adapts in real time to the changing noise environment. For example, if the above system is built into a mobile telephone and the user is standing outside a noisy room, the system can adapt to enhance the speech dependent on whether the door to the room is open or closed. Similarly, if the system is used in a public address system in a railway station, the system can adapt in real time to the changing noise conditions as trains arrive and depart.

In an embodiment, the signal to noise ratio is estimated on a frame by frame basis and the signal to noise ratio for a previous frame is used to update the parameters for a current frame. A typical frame length is from 1 to 3 seconds.

The above system can adapt either the spectral shaping filter and/or the dynamic range compression stage to the noisy environment. In some embodiments, both the spectral shaping filter and the dynamic range compression stage will be adapted to the noisy environment.

When adapting the dynamic range compression in line with the SNR, the control parameter that is updated may be used to control the gain to be applied by said dynamic range compression. In further embodiments, the control parameter is updated such that it gradually suppresses the boosting of the low energy segments of the input speech with increasing signal to noise ratio. In some embodiments, a linear relationship is assumed between the SNR and control parameter, in other embodiments a non-linear or logistic relationship is used.

To control the volume of the output, in some embodiments, the system further comprises an energy banking box, said energy banking box being a memory provided in said system and configured to store the total energy of said input speech before enhancement, said processor being further configured to increase the energy of low energy parts of the enhanced signal using energy stored in the energy banking box.

The spectral shaping filter may comprise an adaptive spectral shaping stage and a fixed spectral shaping stage. The adaptive spectral shaping stage may comprise a formant shaping filter and a filter to reduce the spectral tilt. In an embodiment, a first control parameter is provided to control said format shaping filter and a second control parameter is configured to control said filter configured to reduce the spectral tilt and wherein said first and/or second control parameters are updated in accordance with the signal to noise ratio. The first and/or second control parameters may have a linear dependence on said signal to noise ratio.

The above discussion has concentrated on adapting the signal in response to an SNR. However, the system may be further configured to modify the spectral shaping filter in accordance with the input speech independent of noise measurements. For example, the processor may be configured to estimate the maximum probability of voicing when applying the spectral shaping filter, and wherein the system is configured to update the maximum probability of voicing every m seconds, wherein m is a value from 2 to 10.

The system may also be additionally or alternatively configured to modify the dynamic range compression in accordance with the input speech independent of noise measurements. For example, the processor is configured to estimate the maximum value of the signal envelope of the input speech when applying dynamic range compression and wherein the system is configured to update the maximum value of the signal envelope of the input speech every m seconds, wherein m is a value from 2 to 10.

The system may also be configured to output enhanced speech in a plurality of locations. For example, such a system may comprise a plurality of noise inputs corresponding to the plurality of locations, the processor being configured to apply a plurality of spectral shaping filters and a plurality of corresponding dynamic range compression stages, such that there is a spectral shaping filter and dynamic range compression stage pair for each noise input, the processor being configured to update the control parameters for each spectral shaping filter and dynamic range compression stage pair in accordance with the signal to noise ratio measured from its corresponding noise input. Such a system would be of use for example in a PA system with a plurality of speakers in different environments.

In further embodiments, a method for enhancing speech to be outputted in a noisy environment is provided, the method comprising:

receiving speech to be enhanced;

receiving real-time information concerning the noisy environment at a noise input;

converting speech received from said speech input to enhanced speech; and outputting said enhanced speech, wherein converting said speech comprises:

measuring the signal to noise ratio at the noise input, applying a spectral shaping filter to the speech received via said speech input; and applying dynamic range compression to the output of said spectral shaping filter;

wherein the spectral shaping filter comprises a control parameter and the dynamic range compression comprises a control parameter and wherein at least one of the control parameters for the dynamic range compression or the spectral shaping is updated in real time according to the measured signal to noise ratio.

The above embodiments, have discussed adaptability of the system in response to SNR. However, in some embodiments, the speech is enhanced independent of the SNR of the environment where it is to be output. Here, a speech intelligibility enhancing system for enhancing speech to be output is provided, the system comprising:

a speech input for receiving speech to be enhanced;

an enhanced speech output to output said enhanced speech; and a processor configured to convert speech received from said speech input to enhanced speech to be output by said enhanced speech output, the processor being configured to: apply a spectral shaping filter to the speech received via said speech input; and apply dynamic range compression to the output of said spectral shaping filter, wherein the spectral shaping filter comprises a control parameter and the dynamic range compression comprises a control parameter and at least one of the control parameters for the dynamic range compression or the spectral shaping is updated in real time according to the speech received at the speech input.

For example, the processor may be configured to estimate the maximum probability of voicing when applying the spectral shaping filter, and wherein the system is configured to update the maximum probability of voicing every m seconds, wherein m is a value from 2 to 10.

The system may also be additionally or alternatively configured to modify the dynamic range compression in accordance with the input speech independent of noise measurements. For example, the processor is configured to estimate the maximum value of the signal envelope of the input speech when applying dynamic range compression and wherein the system is configured to update the maximum value of the signal envelope of the input speech every m seconds, wherein m is a value from 2 to 10.

In a further embodiment, a method for enhancing speech intelligibility is provided, the method comprising:

receiving speech to be enhanced;

converting speech received from said speech input to enhanced speech; and outputting said enhanced speech, wherein converting said speech comprises:

applying a spectral shaping filter to the speech received via said speech input; and applying dynamic range compression to the output of said spectral shaping filter, wherein the spectral shaping filter comprises a control parameter and the dynamic range compression comprises a control parameter and at least one of the control parameters for the dynamic range compression or the spectral shaping is updated in real time according to the speech received at the speech input.

Since some methods in accordance with embodiments can be implemented by software, some embodiments encompass computer code provided to a general purpose computer on any suitable carrier medium. The carrier medium can comprise any storage medium such as a floppy disk, a CD ROM, a magnetic device or a programmable memory device, or any transient medium such as any signal e.g. an electrical, optical or microwave signal.

FIG. 1 is a schematic of a speech intelligibility enhancing system.

The system 1 comprises a processor 3 which comprises a program 5 which takes input speech and information about the noise conditions where the speech will be output and enhances the speech to increase its intelligibility in the presence of noise. The storage 7 stores data that is used by the program 5. Details of what data is stored will be described later.

The system 1 further comprises an input module 11 and an output module 13. The input module 11 is connected to an input for data relating to the speech to be enhanced and also and input for collecting data concerning the real time noise conditions in the places where the enhanced speech is to be output. The type of data that is input may take many forms, which will be described in more detail later. The input 15 may be an interface that allows a user to directly input data. Alternatively, the input may be a receiver for receiving data from an external storage medium or a network.

Connected to the output module 13 is output is audio output 17.

In use, the system 1 receives data through data input 15. The program 5 executed on processor 3, enhances the inputted speech in the manner which will be described with reference to FIGS. 2 to 8.

Figure 2:
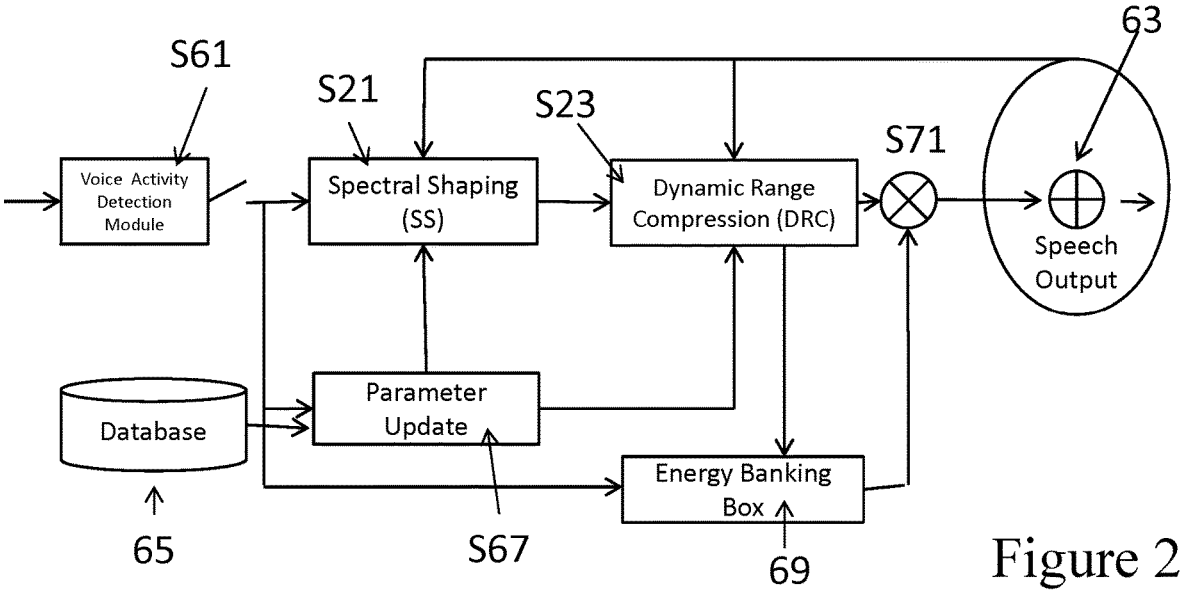
FIG. 2 is a further schematic showing a system in accordance with an embodiment of the present invention with a spectral shaping filter and a dynamic range compression stage.
Figure 3:
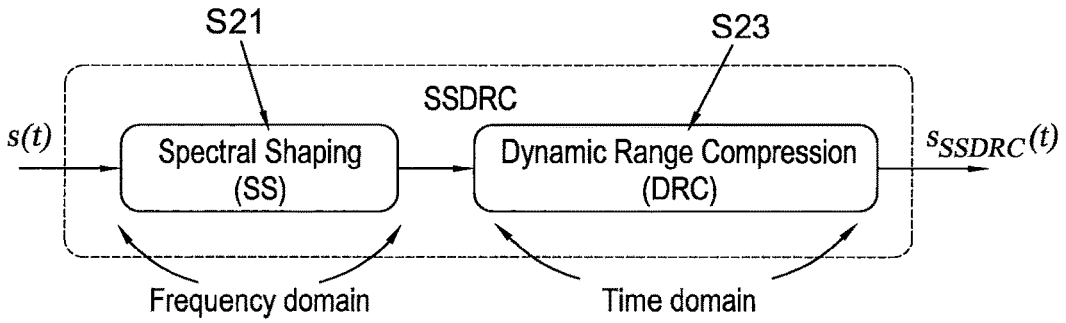
FIG. 3 is a schematic showing the spectral shaping filter and a dynamic range compression stage of FIG. 2.

FIG. 2 is a flow diagram showing the processing steps provided by program 5. In an embodiment, to enhance or boost the intelligibility of the speech, the system comprises a spectral shaping step S21 and a dynamic range compression step S23. These steps are shown in FIG. 3. The output of the spectral shaping step S21 is delivered to the dynamic range compression step S23.

Step S21 operates in the frequency domain and its purpose is to increase the "crisp" and "clean" quality of the speech signal, and therefore improve the intelligibility of speech even in clear (not-noisy) conditions. This is achieved by sharpening the formant information (following observations in clear speech) and by reducing spectral tilt using pre-emphasis filters (following observations in Lombard speech). The specific characteristics of this sub-system are adapted to the degree of speech frame voicing.

Figure 4:
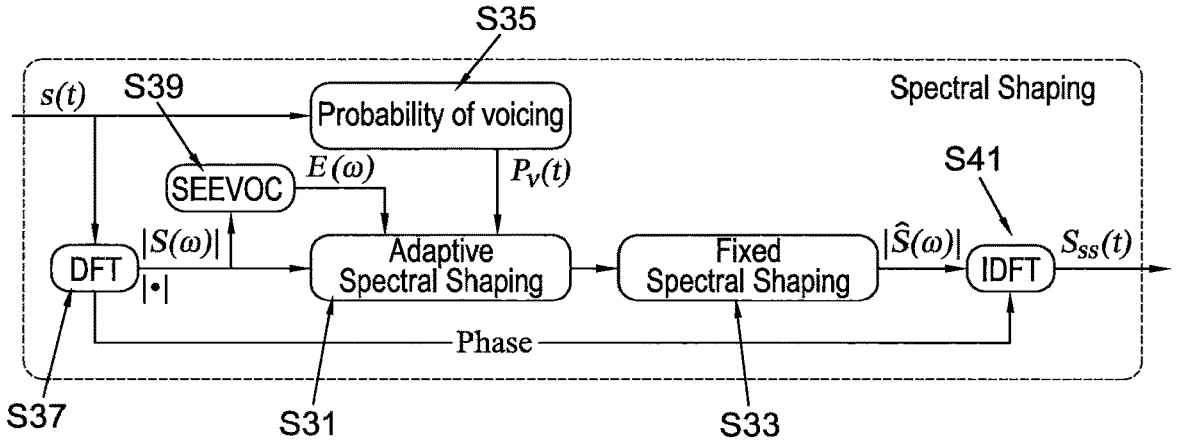
FIG. 4 is a schematic of the spectral shaping filter in more detail.

The steps S21 and S23 are shown in more detail in FIG. 3. For this purpose, several spectral operations are applied all combined into an algorithm which contains two stages:

(i) an adaptive stage S31 (to the voiced nature of speech segments); and (ii) a fixed stage S33 as shown in FIG. 4.

In this embodiment, the spectral intelligibility improvements are applied inside the adaptive Spectral Shaping stage S31. In this embodiment, the adaptive spectral shaping stage comprises a first transformation which is a formant sharpening transformation and a second transformation which is a spectral tilt flattening transformation. Both the first and second transformations are adapted to the voiced nature of speech, given as a probability of voicing per speech frame. These adaptive filter stages are used to suppress artefacts in the processed signal especially in fricatives, silence or other "quiet" areas of speech.

Given a speech frame, the probability of voicing which is determined in step S35 is defined as:

$$P_v(t) = \alpha \frac{\mathrm{rms}(t)}{z(t)} \tag{1}$$

Where $\alpha=1/\max(P_v(t))$ is a normalisation parameter, rms (t) and z(t) denote the RMS value and the zero-crossing rate.

A speech frame $s_r^i(t)$ $$s_r^i(t)=s(t)w_r(t_i-t) \tag{2}$$

is extracted from the speech signal s(t) using a rectangular window $w_r(t)$ centred at each analysis instant $t_i$, In an embodiment, the window is length 2.5 times the average fundamental period of speaker's gender (8:3 ms and 4:5 ms for males and women, respectively). In this particular embodiment, analysis frames are extracted each 10 ms. The two above transformations are adaptive (to the local probability of voicing) filters that are used to implement the adaptive spectral shaping.

First, the formant shaping filter is applied. The input of this filter is obtained by extracting speech frames $s_n^i(t)$ using Hanning windows of the same length as those specified for computing the probability of voicing, then applying an N-point discrete Fourier transform (DFT) in step S37

$$S(\omega_k, t_i) = \frac{1}{N}\sum_{n=0}^{N-1} s_h^i(n)\cdot \varepsilon^{\frac{-j2rkn}{N}} \tag{3}$$

and estimating the magnitude spectral envelope $E(\omega_k; t_i)$ for every frame i. The magnitude spectral envelope is estimated using the magnitude spectrum in (3) and a spectral envelope estimation vocoder (SEEVOC) algorithm in step S39. Fitting the spectral envelope by cepstral analysis provides a set of cepstral coefficients, c:

$$c_m = \frac{1}{N/2+1}\sum_{k=0}^{N/2} \log E(\omega_k, t_i)\cos(m\omega_k) \tag{4}$$

which are used to compute the spectral tilt, $T(\omega, t_1)$:

$$\log T(\omega,t_i)=c_0+2c_1\cos(\omega) \tag{5}$$

Thus, the adaptive formant shaping filter is defined as:

$$H_s(\omega, t_i) = \left(\frac{E(\omega, t_i)}{T(\omega, t_i)}\right)^{\beta P_v(t_i)} \tag{6}$$

The formant enhancement achieved using the filter defined by equation (6) is controlled by the local probability of voicing $P_v(t_i)$ and the β parameter, which allows for an extra noise-dependent adaptivity of $H_s$.

In an embodiment, β is fixed, in other embodiments, it is controlled in accordance with the signal to noise ratio (SNR) of the environment where the voice signal is to be outputted.

For example, β may be set to a fixed value of $\beta_0$. In an embodiment, $\beta_0$ is 0.25 or 0.3. If β is adapted with noise, then for example:

if SNR<=0, $\beta=\beta_0$ if 0<SNR<=15, $\beta=\beta_0*(1-\mathrm{SNR}/15)$ if SNR>15, $\beta=0$ The above example assumes a linear relationship between β and the SNR, but a non-linear relationship could also be used.

The second adaptive (to the probability of voicing) filter which is applied in step S31 is used to reduce the spectral tilt. In an embodiment, the pre-emphasis filter is expressed as:

$$H_p(\omega, t_i) = \begin{cases} 1 & \omega \le \omega_0 \\ 1 + \dfrac{\omega-\omega_0}{\pi-\omega_0} g P_v(t_i) & \omega > \omega_0 \end{cases} \tag{7}$$

where $\omega_0=0{:}1257\pi$ for a sampling frequency of 16 kHz.

In some embodiments, g is fixed, in other embodiments, g is dependent on the SNR environment where the voice signal is to be outputted.

For example, g may be set to a fixed value of $g_0$. In an embodiment, $g_0$ is 0.3. If g is adapted with noise, then for example:

if SNR<=0, $g=g_0$ if 0<SNR<=15, $g=g_0*(1-\mathrm{SNR}/15)$ if SNR>15, g=0

The above example assumes a linear relationship between g and the SNR, but a non-linear relationship could also be used.

The fixed Spectral Shaping step (S33) is a filter $H_r(\omega; t_i)$ used to protect the speech signal from low-pass operations during its reproduction. In frequency, $H_r$ boosts the energy between 1000 Hz and 4000 Hz by 12 dB/octave and reduces by 6 dB/octave the frequencies below 500 Hz. Both voiced and unvoiced speech segments are equally affected by the low-pass operations. In this embodiment, the filter is not related to the probability of voicing.

Finally, after the magnitude spectra are modified accordingly to:

$$|\hat{S}(\omega,t_i)|=|S\omega,t_i)|\cdot H_s(\omega,t_i)\cdot H_p(\omega,t_i)\cdot H_r(\omega,t_i) \tag{8}$$

the modified speech signal is reconstructed by means of inverse DFT (S41) and Overlap-and-Add, using the original phase spectra as shown in FIG. 4.

In the above described spectral shaping step, the parameters β and g may be controlled in accordance with real time information about the signal to noise ratio in the environment where the speech is to be outputted.

Figure 5:
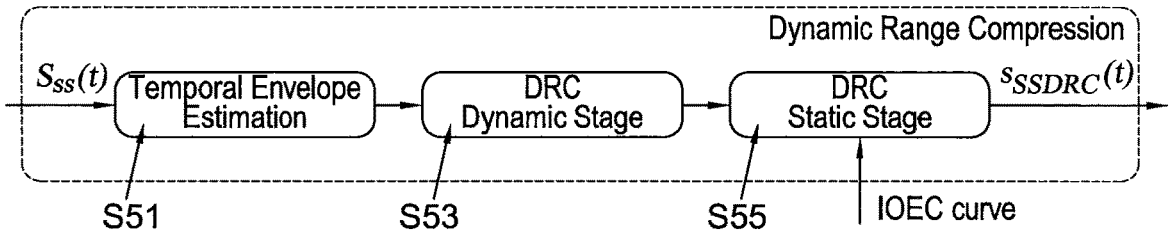
FIG. 5 is a schematic showing the dynamic range compression stage in more detail.

Returning to FIG. 2, the dynamic range compression step S23 will be described in more detail with reference to FIG. 5.

The signal's time envelope is estimated in step S51 using the magnitude of the analytical signal:

$$\tilde{e}(n)=|s(n)+j\check{s}(n)| \tag{9}$$

where $\check{s}(n)$ denotes the Hilbert transform of the speech signal s(n). Furthermore, because the estimate in (9) has fast fluctuations, a new estimate e(n) is computed based on a moving average operator with order given by the average pitch of the speaker's gender. In an embodiment, the speaker's gender is assumed to be male since the average fundamental period is longer for men. However, in some embodiments as noted above, the system can be adapted specifically for female speakers with a shorter fundamental period.

The signal is then passed to the DRC dynamic step S53. In an embodiment, during the DRC's dynamic stage S53, the envelope of the signal is dynamically compressed with 2 ms release and almost instantaneous attack time constants:

$$\hat{e}(n)=\begin{cases} a_r\hat{e}(n-1)+(1-a_r)e(n), & \text{if } e(n)<\hat{e}(n-1) \\ a_a\hat{e}(n-1)+(1-a_a)e(n), & \text{if } e(n)\geq\hat{e}(n-1) \end{cases} \tag{10}$$

where $a_r$=0.15 and $a_a$=0.0001.

Following the dynamic stage S53, a static amplitude compression step S55 controlled by an Input-Output Envelope Characteristic (IOEC) is applied.

Figure 6:
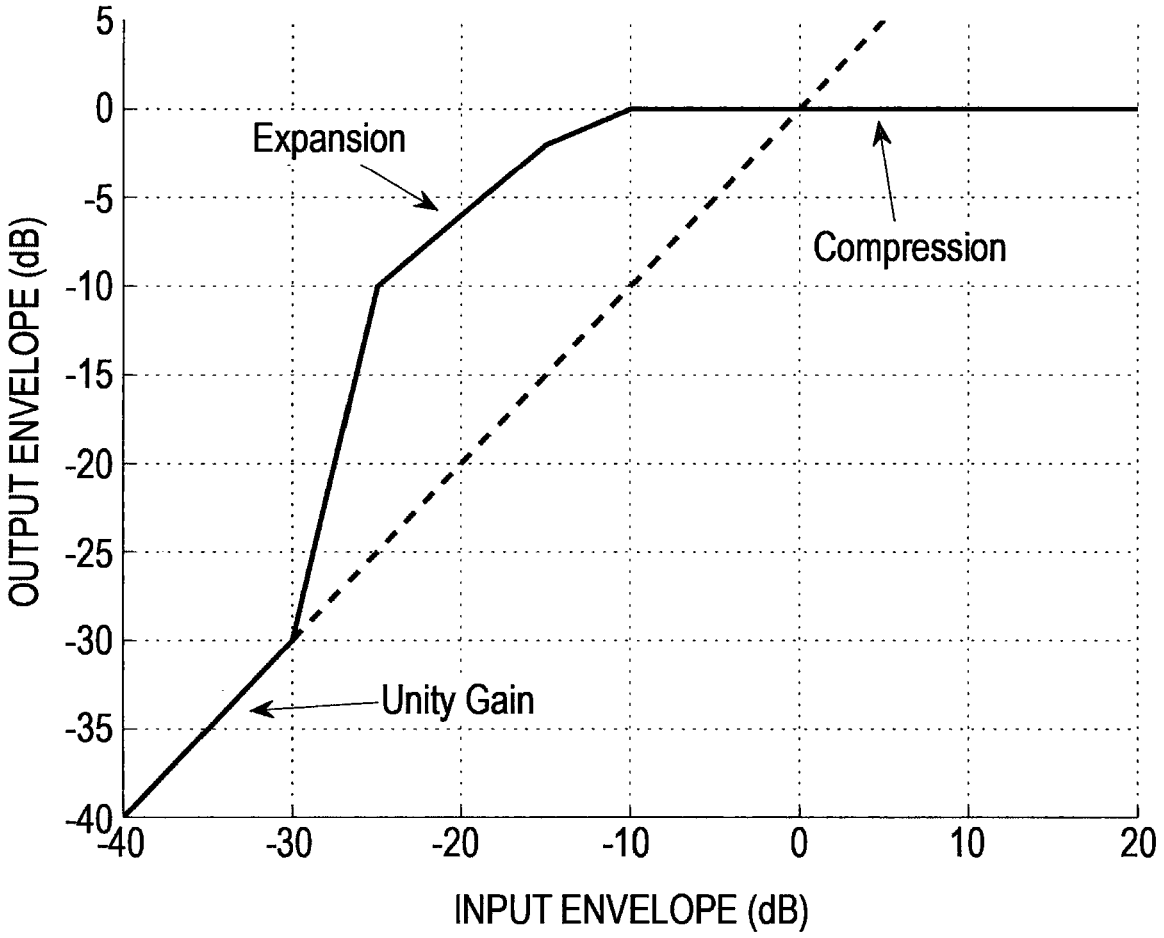
FIG. 6 is a plot of a input-output envelope characteristic curve.
Figure 7A:
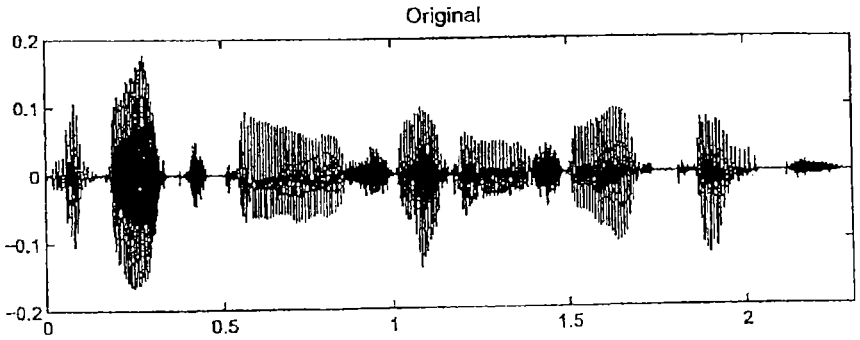
FIG. 7A is a plot of a speech signal and FIG. 7B is a plot of the output from the dynamic range compression stage.
Figure 7B:
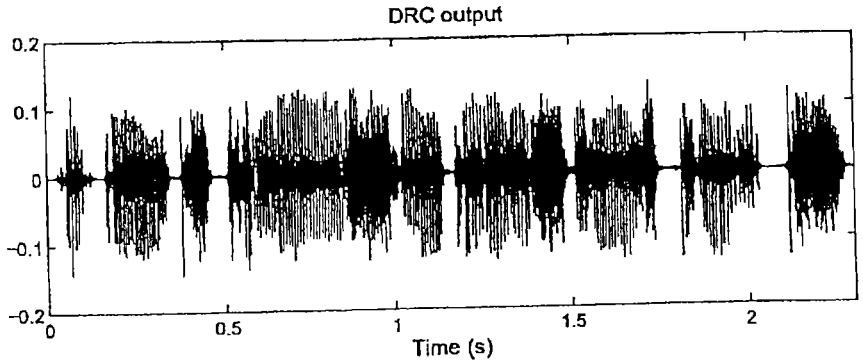

The IOEC curve depicted in FIG. 6 is a plot of the desired output in decibels against the input in decibels. Unity gain is shown as a straight dotted line and the desired gain to implement DRC is shown as a solid line. This curve is used to generate time-varying gains required to reduce the envelope's variations. To achieve this, first the dynamically compressed ê(n) is transposed in dB $$e_{in}(n)=20\log_{10}(\hat{e}(n)/c_0) \tag{11}$$

setting the reference level $e_0$, to 0.3 the maximum level of the signal's envelope, selection that provided good listening results for a broad range of SNRs. Then, applying the IOEC to (11) generates $e_{out}$(n) and allows the computation of the time-varying gains:

$$g(n)=10^{(e_{out}(n)=e_{in}(n))/20} \tag{12}$$

which produces the DRC-modified speech signal which is shown in FIG. 7(*b*). FIG. 7(*a*) shows the speech before modification.

$$s_g(n)=g(n)s(n) \tag{13}$$

As a final step, the global power of $s_g$ (n) is altered to match the one of the unmodified speech signal.

In an embodiment, the IOEC curve is controlled in accordance with the SNR where the speech is to be output. Such a curve is shown in FIG. 8.

Figure 8:
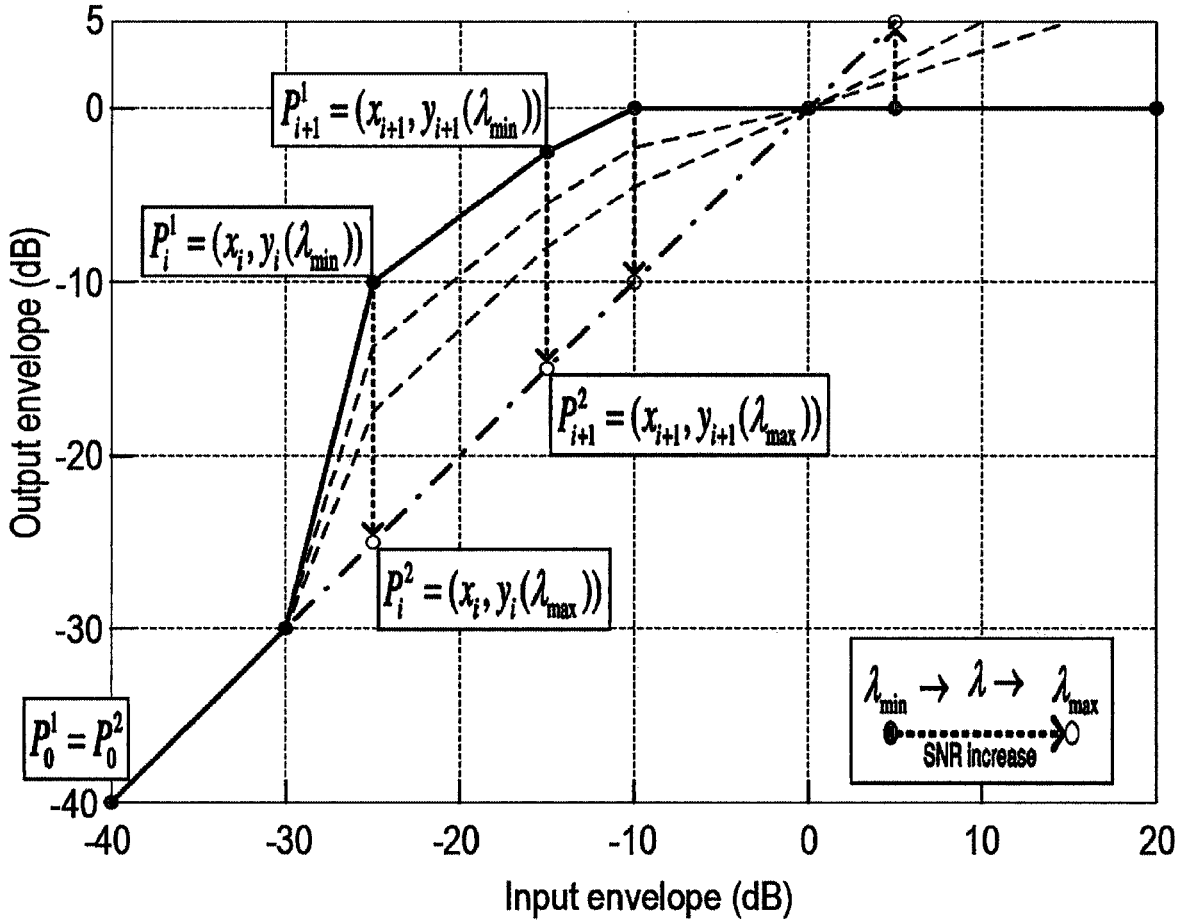
FIG. 8 is a plot of an input-output envelope characteristic curve adapted in accordance with a signal to noise ratio.

In FIG. 8, as the current SNR, increases from a specified minimum value $\lambda_{max}$, towards a maximum value $\lambda_{max}$, the IOEC is modified from the curve depicted in FIG. 6 towards the bisector of the first quadrant angle. At $\lambda_{min}$, the signal's envelope is compressed by the baseline DRC as shown by the solid line, while at $\lambda_{max}$ no-compression is taking place. In between, different morphing strategies may be used for the SNR-adaptive IOEC. The levels $\lambda_{min}$ and $\lambda_{max}$ are given as input parameters for each type of noise. E.g., for SSN type of noise they may be chosen −9 dB and 3 dB.

A piecewise linear IOEC (as the one given in FIG. 8) is obtained using a discrete set of M points $P_i^1=\overline{0,M-1}$. Further on, $x_i$ and $y_i$ will denote respectively the input and output levels of IOEC at point i. Also, the discrete family of M points denoted as $P_i^2=(x_i, y_i(\lambda))$ in FIG. 8 parameterize the modified IOEC with respect to a given SNR λ. In this context, the noise adaptive IOEC segment $(P_i^2, P_{i+1}^2)$ has the following analytical expression:

$$(P_i^2,P_{i+1}^2):y(x,\lambda)=\alpha(\lambda)x+b(\lambda);x\epsilon[x_i,x_{i+1}] \tag{14}$$

where a(λ) is the segment's slope $$a(\lambda)=\frac{y_{i+1}(\lambda)-y_i(\lambda)}{x_{i+1}-x_i} \tag{15}$$

and b(λ) is the segment's offset $$b(\lambda)=y_i(\lambda)-a(\lambda)x_i \tag{16}$$

Two embodiments will now be discussed where respectively two types of effective morphing methods were selected to control the IOEC curve: a linear and a non-linear (logistic) slope variation over λ. For an embodiment, where a linear relationship is employed, the following expression may be used for a:

$$a(\lambda)=\begin{cases} A\lambda+B, & \text{if } \lambda_{min}\leq\lambda\leq\lambda_{max} \\ 1, & \text{if } \lambda>\lambda_{max} \\ a(\lambda_{min}), & \text{if } \lambda<\lambda_{min} \end{cases} \tag{17}$$

where $$A=\frac{1-a(\lambda_{min})}{\lambda_{max}-\lambda_{min}}$$

and $$B=\frac{a(\lambda_{min})\lambda_{max}-\lambda_{min}}{\lambda_{max}-\lambda_{min}}.$$

For the non-linear (logistic) form:

$$a(\lambda)=\begin{cases} \tilde{A}+\dfrac{\tilde{B}}{1+e^{-\frac{\lambda-\lambda_0}{\sigma_0}}}, & \text{if } \lambda_{min}\leq\lambda\leq\lambda_{max} \\ 1, & \text{if } \lambda>\lambda_{max} \\ a(\lambda_{min}), & \text{if } \lambda<\lambda_{min} \end{cases} \tag{18}$$

where $\lambda_0$ is the logistic offset, $\sigma_0$ is the logistic slope, while $$\tilde{B}=\frac{(a(\lambda_{min})-1)\left(1+e^{-\frac{\lambda_{min}-\lambda_0}{\sigma_0}}\right)\left(1+e^{-\frac{\lambda_{max}-\lambda_0}{\sigma_0}}\right)}{e^{-\frac{\lambda_{max}-\lambda_0}{\sigma_0}}-e^{-\frac{\lambda_{min}-\lambda_0}{\sigma_0}}} \tag{19}$$

and $$\tilde{A}=a(\lambda_{min})-\frac{\tilde{B}}{1+e^{-\frac{\lambda_{min}-\lambda_0}{\sigma_0}}} \tag{20}$$

In an embodiment, $\lambda_0$ and $\sigma_0$ are constants given as input parameters for each type of noise (e.g., for SSN type of noise they may be chosen −6 dB and 2, respectively). In a further embodiment, and $\lambda_0$ or $\sigma_0$ may be controlled in accordance with the measured SNR. For example, they may be controlled as described above for β and g with a linear relationship on the SNR.

Finally, imposing $P_0^1=P_0^2$ adaptive IOEC is computed for a given λ, considering the expression (17) or (18) as slopes for each of its segments $i=\overline{1,M-1}$. Then, using (14) the new piecewise linear IOEC is generated.

Psychometric measurements have indicated that speech intelligibility changes with SNR following a logistic function of the type used in accordance with the above embodiment.

In the above embodiments, the spectral shaping step S21 and the DRC step S23 are very fast processes which allow real time execution at a perceptual high quality modified speech.

Systems in accordance with the above described embodiments, show enhanced performance in terms of speech intelligibility gain especially for low SNRs. They also provide suppression of audible arte-facts inside the modified speech signal at high SNRs. At high SNRs, increasing the amplitude of low energy segments of speech (such as unvoiced speech) can cause perceptual quality and intelligibility degradation.

Systems and methods in accordance with the above embodiments provide a light, simple and fast method to adapt dynamic range compression to the noise conditions, inheriting high speech intelligibility gains at low SNRs from the non-adaptive DRC and improve perceptual quality and intelligibility at high SNRs.

Returning to FIG. 2, an entire system is shown where stages S21 and S23 have been described in detail with reference to FIGS. 3 to 8.

If speech is not present the system is off. In stage S61 a voice activity detection module is provided to detect the presence of speech. Once speech is detected, the speech signal is passed for enhancement. The voice activity detection module may employ a standard voice activity detection (VAD) algorithm can be used.

The speech will be output at speech output 63. Sensors are provided at speech output 63 to allow the noise and SNR at the output to be measured. The SNR determined at speech output 63 is used to calculate β and g in stage S21. Similarly, the SNR λ is used to control stage S23 as described in relation to FIG. 5 above.

The current SNR at frame t is predicted from previous frames of noise as they have been already observed in the past (t-1, t-2, t-3 . . . ). In an embodiment, the SNR is estimated using long windows in order to avoid fast changes in the application of stages S21 and S23. In an example, the window lengths can be from 1 s to 3 s.

The system of FIG. 2 is adaptive in that it updates the filters applied in stage S21 and the IOEC curve of step S23 in accordance with the measured SNR. However, the system of FIG. 2 also adapts stages S21 and/or S23 dependent on the input voice signal independent of the noise at speech output 63. For example, in stage S23, the maximum probability of voicing can be updated every n seconds, where n is a value between 2 and 10, in one embodiment, n is from 3-5.

In stage S23, in the above embodiment, $e_0$ was set to 0.3 times the maximum value of the signal envelope. This envelope can be continually updated dependent on the input signal. Again, the envelope can be updated every n seconds, where n is a value between 2 and 10, in one embodiment, n is from 3-5.

The initial values for the maximum probability of voicing and the maximum value of the signal envelope are obtained from database 65 where speech signals have been previously analysed and these parameters have been extracted. These parameters are passed to parameter update stage S67 with the speech signal and stage S67 updates these parameters.

In an embodiment, the dynamic range compression, energy is distributed over time. This modification is constrained by the following condition: total energy of the signal before and after modifications should remain the same (otherwise one can increase intelligibility by increasing the energy of the signal i.e the volume). Since the signal which is modified is not known a priori, Energy Banking box 69 is provided. In box 69, energy from the most energetic part of speech is "taken" and saved (as in a Bank) and it is then distributed to the less energetic parts of speech. These less energetic parts are very vulnerable to the noise. In this way, the distribution of energy helps the overall the modified signal to be above the noise level. In an embodiment, this can be implemented by modifying equation (13) to be:

$$s_{ga}(n)=s_{ga}(n)a(n) \tag{20}$$

Where a(n) is calculated from the values saved in the energy banking box to allow the overall modified signal to be above the noise level.

$$\text{If } E(s_g(n))>E(\text{Noise}(n)) \text{ then } a(n)=1, \tag{21}$$

where $E(s_g(n))$ is the energy of the enhanced signal $s_g(n)$ for the frame (n) and E(Noise(n)) is the energy of the noise for the same frame.

If $E(s_g(n))\leq E(\text{Noise}(n))$ the system attempts to further distribute energy to boost low energy parts of the signal so that they are above the level of the noise. However, the system only attempts to further distribute the energy if there is energy $E_b$ stored in the energy banking box.

If the gain g(n)<1, then the energy difference between the input signal and the enhanced signal $(E(s(n))-E(s_g(n)))$ is stored in the energy banking box. The energy banking box stores the sum of these energy differences where g(n)<1 to provide the stored energy $E_b$.

To calculate a(n) when $E(s_g(n))\leq E(\text{Noise}(n))$, a bound on α is derived as $\alpha_1$:

$$\alpha_1(n) = \frac{E(\text{noise}(n))}{E(s_g(n))} \tag{22}$$

A second expression $a_2$ (n) for a(n) is derived using $E_b$ $$\alpha_2(n) = \gamma\frac{E_b}{E(s_g(n))} + 1 \tag{23}$$

Where γ is a parameter chosen such that $0<\gamma\leq 1$ which expresses a percentage of the energy bank which can be allocated to a single frame. In an embodiment, γ=0.2, but other values can be used.

$$\text{If } \alpha_2(n)\geq\alpha_1, \text{ then } \alpha(n)=\alpha_2(n) \tag{24}$$

However, $$\text{If } \alpha_2(n)<\alpha_1, \text{ then } \alpha(n)=1 \tag{25}$$

When energy is distributed as above, the energy is removed from the energy banking box $E_b$ such that the new value of $E_b$ is:

$$E_b-E(s_g(n))(\alpha(n)-1) \tag{26}$$

Once α(n) is derived, it is applied to the enhanced speech signal in step S71.

The system of FIG. 2 can be applied to devices producing speech as output (cell phones, TVs, tablets, car navigation etc.) or accepting speech (i.e., hearing aids). The system can also be applied to Public Announcement apparatus. In such a system, there may be a plurality of speech outputs, for example, speakers, located in a number of places, e.g. inside or outside a station, in the main area of an airport and a business lounge. The noise conditions will vary greatly between these environments. The system of FIG. 2 can therefore be modified to produce one or more speech outputs as shown in FIG. 9.

Figure 9:
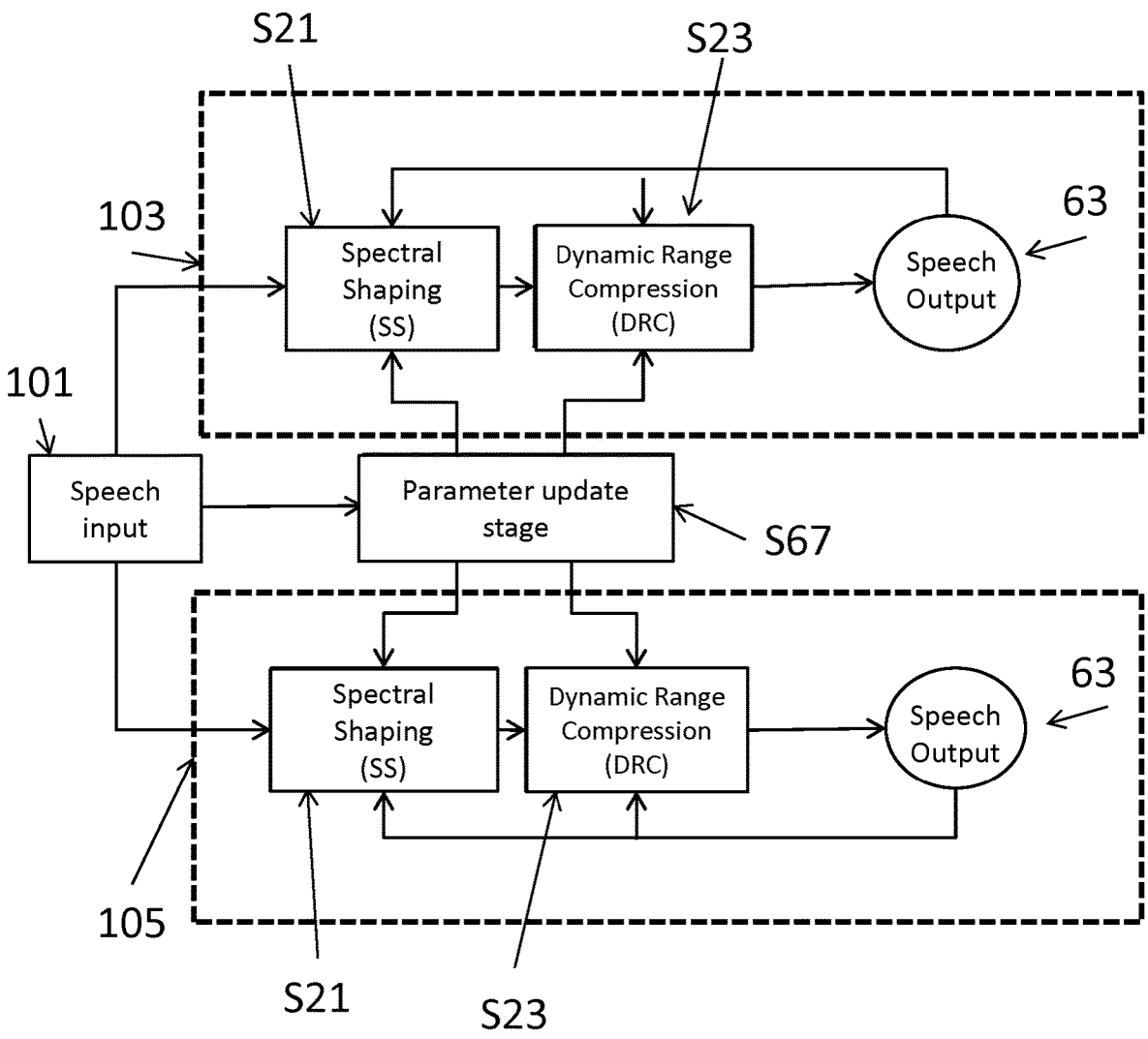
FIG. 9 is a schematic of a system in accordance with a further embodiment with multiple outputs.

The system of FIG. 9 has been simplified to show a speech input 101, which is then split to provide an input into a first sub-system 103 and a second subsystem 105. Both the first and second subsystems comprise a spectral shaping stage S21 and a dynamic range compression stage S23. The spectral shaping stage S21 and the dynamic range compression stage S23 are the same as those described in relation to FIGS. 2 to 8. Both subsystems comprise a speech output 63 and the SNR at the speech output 63 for the first subsystem is used to calculate β, g and the IOEC curve for stages S21 and S23 of the first subsystem. The SNR at the speech output 63 for the second subsystem 105 is used to calculate β, g and the IOEC curve for stages S21 and S23 of the second subsystem 105. The parameter update stage S67 can be used to supply the same data to both subsystems as it provides parameters calculated from the input speech signal. For clarity the Voice activity detection module and the energy banking box have been omitted from FIG. 9, but they will both be present in such a system.

While certain embodiments have been described, these embodiments have been presented by way of example only, and are not intended to limit the scope of the inventions. Indeed the novel methods and apparatus described herein may be embodied in a variety of other forms; furthermore, various omissions, substitutions and changes in the form of methods and apparatus described herein may be made without departing from the spirit of the inventions. The accompanying claims and their equivalents are intended to cover such forms of modifications as would fall within the scope and spirit of the inventions.

The invention claimed is:

1. A speech intelligibility enhancing system for enhancing speech to be outputted in a noisy environment, the system comprising:

a speech input for receiving speech to be enhanced;

a noise input for receiving information concerning the noisy environment;

an enhanced speech output to output said enhanced speech; and a processor configured to convert speech received from said speech input to enhanced speech and to output the enhanced speech at said enhanced speech output, the processor being configured to:

apply a spectral shaping filter to the speech received via said speech input wherein the spectral shaping filter is adapted to the probability of voicing;

apply dynamic range compression to the output of said spectral shaping filter, said dynamic range compression comprising applying a static amplitude compression controlled by an input-output envelope characteristic; and measure the time domain noise at the noise input, wherein the spectral shaping filter comprises a spectral shaping control parameter which controls the dependence of the spectral shaping on the probability of voicing and the dynamic range compression comprises a dynamic range compression control parameter wherein at least one of the dynamic range compression control parameter or the spectral shaping control parameter is updated according to a time domain signal to noise ratio;

wherein the time domain signal to noise ratio is estimated on a frame by frame basis, and wherein the time domain signal to noise ratio for a current frame is estimated from the measured time domain noise from multiple previous frames, over windows with a length greater than or equal to 1 second, such that the time domain signal to noise ratio for the current frame is estimated using the window with a length greater than or equal to 1 second and is used to update the dynamic range compression control parameter or the spectral shaping control parameter for a current frame.

2. A system according to claim 1, wherein the dynamic range compression control parameter controls the input output envelope characteristic.

3. A system according to claim 1, wherein the dynamic range compression control parameter is used to control the gain to be applied by said dynamic range compression.

4. A system according to claim 3, wherein the dynamic range compression is configured to redistribute the energy of the speech received at the speech input and wherein the dynamic range compression control parameter is updated such that it suppresses the redistribution of energy with increasing time domain signal to noise ratio.

5. A system according to claim 3, wherein there is a linear relationship between the dynamic range compression control parameter and the time domain signal to noise ratio.

6. A system according to claim 3, wherein there is a non-linear relationship between the dynamic range compression control parameter and the time domain signal to noise ratio.

7. A system according to claim 1, wherein the system further comprises an energy banking box, said energy banking box being a memory provided in said system and configured to store the total energy of said speech received at said speech input before enhancement, said processor being further configured to redistribute energy from high energy parts of the speech to low energy parts using said energy banking box.

8. A system according to claim 1, wherein the spectral shaping filter comprises an adaptive spectral shaping stage and a fixed spectral shaping stage.

9. A system according to claim 8, wherein the adaptive spectral shaping stage comprises a sharpening filter and a spectral tilt filter to reduce the spectral tilt.

10. A system according to claim 9, wherein the processor is configured to update the spectral shaping control parameter and wherein a first control parameter is provided to control said sharpening filter and a second control parameter is configured to control said spectral tilt filter and wherein said first and/or second control parameters are updated in accordance with the time domain signal to noise ratio, such that the spectral shaping control parameter is the first control parameter or the second control parameter.

11. A system according to claim 10, wherein the first and/or second control parameters have a linear dependence on said time domain signal to noise ratio.

12. A system according to claim 1, wherein the processor is further configured to modify the spectral shaping filter in accordance with the input speech independent of noise measurements.

13. A system according to claim 12, wherein the processor is configured to estimate a maximum probability of voicing when applying the spectral shaping filter, and wherein the processor is configured to update the maximum probability of voicing every m seconds, wherein m is a value from 2 to 10.

14. A system according to claim 1, wherein the processor is further configured to modify the dynamic range compression in accordance with the input speech independent of noise measurements.

15. A system according to claim 14, wherein the processor is configured to estimate the maximum value of the signal envelope of the speech received at the speech input when applying dynamic range compression and wherein the processor is configured to update the maximum value of the signal envelope of the input speech every m seconds, wherein m is a value from 2 to 10.

16. A system according to claim 1, comprising:

a plurality of enhanced speech outputs, a plurality of noise inputs corresponding to the plurality of outputs, a processor configured to apply a plurality of spectral shaping filters and a plurality of corresponding dynamic range compression stages, such that there is a spectral shaping filter and dynamic range compression stage pair for each noise input, the processor being configured to update the dynamic range compression control parameter or the spectral shaping control parameter for each spectral shaping filter and dynamic range compression stage pair in accordance with the time domain signal to noise ratio measured from its corresponding noise input.

17. A method for enhancing speech to be outputted in a noisy environment, the method comprising:

receiving speech to be enhanced;

receiving information concerning the noisy environment at a noise input;

converting speech received from said speech input to enhanced speech; and outputting said enhanced speech, wherein converting said speech comprises:

measuring the time domain noise at the noise input, applying a spectral shaping filter to the speech received via said speech input wherein the spectral shaping filter is adapted to the probability of voicing; and applying dynamic range compression to the output of said spectral shaping filter wherein said dynamic range compression comprises applying a static amplitude compression controlled by an input-output envelope characteristic;

wherein the spectral shaping filter comprises a spectral shaping control parameter which controls the dependence of the spectral shaping on the probability of voicing and the dynamic range compression comprises a dynamic range compression control parameter and wherein at least one of the dynamic range compression control parameter or the spectral shaping control parameter is updated according to a time domain signal to noise ratio;

wherein the time domain signal to noise ratio is estimated on a frame by frame basis and wherein the time domain signal to noise ratio for a current frame is estimated from the measured time domain noise from multiple previous frames, over windows with a length greater than or equal to 1 second, such that the time domain signal to noise ratio for the current frame is estimated using the window with a length greater than or equal to 1 second and used to update the dynamic range compression control parameter or the spectral shaping control parameter for a current frame.

18. A non-transitory computer readable storage medium comprising computer readable code configured to cause a computer to perform the method of claim 17.

19. A speech intelligibility enhancing system for enhancing speech to be output, the system comprising:

a speech input for receiving speech to be enhanced;

an enhanced speech output to output said enhanced speech; and a processor configured to:

convert speech received from said speech input to enhanced speech and to output the enhanced speech at said enhanced speech output, the processor being configured to:

apply a spectral shaping filter to the speech received via said speech input wherein the spectral shaping filter is adapted to the probability of voicing, wherein the probability of voicing is scaled with a normalisation parameter;

estimate a maximum value of the signal envelope; and apply dynamic range compression to the output of said spectral shaping filter; wherein said dynamic range compression comprises applying a static amplitude compression controlled by an input-output envelope characteristic, wherein the maximum value of the signal envelope is used to set a reference level for the input envelope before the static amplitude compression controlled by the input-output envelope characteristic is applied, wherein the processor is further configured to update the maximum value of the signal envelope every m seconds, wherein m is a value greater than or equal to 2, such that the dynamic range compression is modified in real time according to the speech received at the speech input to enhance the speech to be output;

wherein the spectral shaping filter comprises a spectral shaping control parameter which is the normalisation parameter.

20. A method for enhancing speech intelligibility, the method comprising:

receiving speech to be enhanced;

converting speech received from said speech input to enhanced speech; and outputting said enhanced speech, wherein converting said speech comprises:

applying a spectral shaping filter to the speech received via said speech input wherein the spectral shaping filter is adapted to the probability of voicing, wherein the probability of voicing is scaled with a normalisation parameter;

estimating a maximum value of the signal envelope; and applying dynamic range compression to the output of said spectral shaping filter wherein said dynamic range compression comprises applying a static amplitude compression controlled by an input-output envelope characteristic, wherein the maximum value of the signal envelope is used to set a reference level for the input envelope before the static amplitude compression controlled by the input-output envelope characteristic is applied, and updating the maximum value of the signal envelope every m seconds, wherein m is a value greater than or equal to 2, such that the dynamic range compression is modified in real time according to the speech received at the speech input to enhance the speech to be output;

wherein the spectral shaping filter comprises a spectral shaping control parameter which is the normalisation parameter.

21. A non-transitory computer readable storage medium comprising computer readable code configured to cause a computer to perform the method of claim 20.

* * * * *